United States Patent [19]

Horn et al.

[11] Patent Number: 4,460,418

[45] Date of Patent: Jul. 17, 1984

[54] ALUMINUM SHEET HAVING IMPROVED WELDABILITY

[75] Inventors: Werner Horn, Singen; Jürgen Hennings, Gottmadingen, both of Fed. Rep. of Germany

[73] Assignee: Swiss Aluminum Ltd., Chippis, Switzerland

[21] Appl. No.: 342,506

[22] Filed: Jan. 25, 1982

Related U.S. Application Data

[62] Division of Ser. No. 141,430, Apr. 18, 1980, Pat. No. 4,326,895.

[30] Foreign Application Priority Data

May 2, 1979 [DE] Fed. Rep. of Germany ..... 2917627

[51] Int. Cl.[3] ..... C22C 21/00

[52] U.S. Cl. ..... 148/437; 148/439; 148/440

[58] Field of Search ..... 148/32, 32.5, 11.5 A

[56] References Cited

U.S. PATENT DOCUMENTS 4,093,474 6/1978 Sperry et al. ..... 148/11.5 A

*Primary Examiner*—R. Dean

*Attorney, Agent, or Firm*—Bachman and LaPointe

[57] ABSTRACT

In order to improve the weldability of aluminum strip or sheet by spot welding and to promote the use of these materials, in particular in the bodywork of automobiles, the strip or sheet, after being hot and cold rolled to an intermediate thickness of 1.5 to 2.5 times the final gauge, is etched in an alkaline solution, then cold rolled to final gauge using cold rolling lubricant and finally, if desired, heat treated.

4 Claims, No Drawings

ALUMINUM SHEET HAVING IMPROVED WELDABILITY

This is a division of application Ser. No. 141,430, filed Apr. 18, 1980, now U.S. Pat. No. 4,326,895.

BACKGROUND OF THE INVENTION

The present invention relates to a hot and cold rolling process for manufacturing aluminum strip or sheet characterized by improved weldability, in particular aluminum strip about 0.1 to 0.7 mm thick for use in motor car bodies.

The use of aluminum sheet for manufacturing car body parts such as doors, engine bonnets, boot lids and wings is well known. Because of planned measures to save energy, in particular in view of the existing laws in the United States of America, vehicles will have to be made lighter. The increased use of strong and readily formable aluminum alloys for car body parts is therefore strongly anticipated.

Spot welding is widely used for joining components in car manufacturing, the lifetime of the electrodes used for welding steel sheet being about 10,000–15,000 welds. The corresponding number of welds with aluminum sheet is at present around 100–150 welds. After that, the copper electrodes have to be cleaned to remove the aluminum which has alloyed itself with the copper.

The reason for the greater degree of alloying between aluminum and copper than between copper and steel is, besides the physical and thermodynamic properties of copper and aluminum which cannot be changed, the relatively marked variation in contact resistance between the copper electrode and the aluminum sheet. This is due mainly to the thickness of the oxide layer and the composition of the surface layer. It is well known that the contact resistance of aluminum alloys has a great influence on the ease of spot welding, the main reason for irregularity in welding and the short life-times of the electrodes used with untreated aluminum sheet being the high and non-uniform contact resistance at the point of current transfer. These affect energy conversion in the secondary circuit and cause marked variation in the quality of the joint.

Surface treatments such as brushing, sand blasting, wet jetting and caustic etching of the aluminum before spot welding markedly reduce the contact resistance. However, in the case of aluminum sheet, the rolled surface when subjected to those treatments becomes very rough. This affects the uniformity of the surface and detracts from the appearance of the part after lacquering.

It is therefore the principal object of the present invention to develop a process for producing readily formable aluminum strip and sheet characterized by superior spot welding properties and furthermore having a surface which is suitable for shaping and lacquering.

SUMMARY OF THE INVENTION

The object is achieved by way of the present invention wherein, after the strip or sheet has been hot and cold rolled to an intermediate thickness of 1.5 to 2.5 times the final thickness, it is etched in an alkaline solution and then cold rolled to its final gauge using cold rolling lubricant. The strip may then be finally heat treated if desired.

DETAILED DESCRIPTION

It was found, surprisingly, that a considerable improvement in spot welding properties could be achieved by removing the surface layer which raises the contact resistance, when the material has reached an intermediate thickness of 1.5–2.5 times the final gauge. The subsequent cold rolling and heat treatment detract only insignificantly from this good spot weldability. Consequently, it is possible by subsequent cold rolling, to obtain a surface which is suitable for shaping and lacquering. This route is also more economical than treating the surface of the finished strip, as the surface area is smaller at the intermediate stage.

In this connection the aluminum alloys of the following composition have been found to be particularly favorable:

1. 0.4 to 1.5% Mg, 0.3 to 1.5% Si,
   0 to 0.03% Cu, 0 to 0.5% Fe,
   0 to 0.1% Mn, rest aluminum.
2. 0.3 to 6% Mg, 0 to 1% Mn,
   0 to 0.4% Si, 0 to 0.4% Fe,
   0 to 0.2% Cu, 0 to 0.5% Cr, rest aluminum.
3. 1.0 to 5.0% Cu, 0.4 to 2.5% Mg,
   0 to 0.8% Si, 0 to 0.7% Fe,
   0 to 1.5% Mn.

These are then hot and cold rolled, subjected to caustic etching, rolled to final gauge and heat treated.

For the etching of the aluminum an alkaline solution is suitable and a solution of caustic soda, polyphosphate, wetting agents and inhibitors is preferred.

Also within the scope of the present invention is the use of aluminum strip or sheet as spot welded parts or devices, in particular sheet for car bodies, such that the aluminum strip or sheet, after being hot and cold rolled to an intermediate thickness of ca. 1.5 to 2.5 times the final thickness, is etched in an alkaline solution and then cold rolled to the final gauge using cold rolling lubricant, and then, if desired, heat treated.

EXAMPLES

One strip each of the following materials (a) Pure aluminum (98.7%)

(b) AlMgSi containing 0.4% Mg and 1.2% Si, and (c) AlMg3 was produced in the following forms:

1. Without intermediate caustic etching i.e. by the normal production route,
2. with intermediate caustic etching and subsequent rolling down to final gauge before heat treating.

The contact resistance values between the copper electrode and these sheet materials are listed in the following table:

| Alloy | Version | Contact Resistance Cu/Al sheet (μΩ) | Scatter (μΩ) |
|---|---|---|---|
| Al 98.7 | 1 | 32 | ±10 |
| soft | 2 | 13.1 | ±3 |
| AlMg 0.4 | 1 | 15.1 | ±6.3 |
| Si 1.2 | 2 | 4.3 | ±2.2 |
| AlMg 3 | 1 | 290 | ±40 |
| soft | 2 | 30 | ±5 |

What is claimed is:

1. An aluminum body sheet characterized by improved weldability wherein said aluminum has been rolled to an intermediate thickness of from about 1.5 to 2.5 times the final gauge, then etched in an alkaline solution and then rolled to final thickness wherein said aluminum body sheet is characterized by a contact resistance substantially less than the contact resistance of an aluminum body sheet which has not been etched prior to rolling to final thickness.

2. An aluminum body sheet according to claim 1 wherein said aluminum sheet comprises an aluminum alloy consisting essentially of 0.4–1.5% magnesium, 0.3–1.5% silicon, 0–0.03% copper, 0–0.5% iron, 0–1.0% manganese, balance aluminum.

3. An aluminum body sheet according to claim 1 wherein said aluminum sheet comprises an aluminum alloy consisting essentially of 0.3–6% magnesium, 0–1.0% manganese, 0–0.4% silicon, 0–0.4% iron, 0–0.2% copper, 0–0.5% chromium, balance aluminum.

4. An aluminum body sheet according to claim 1 wherein said aluminum sheet comprises an aluminum alloy consisting essentially of 1.0–5.0% copper, 0.4–2.5% magnesium, 0–0.8% silicon, 0–0.7% iron, 0–1.5% manganese, balance aluminum.

* * * * *